US005186408A

United States Patent [19]

Planeta

[11] Patent Number: 5,186,408

[45] Date of Patent: Feb. 16, 1993

[54] MACHINE FOR WINDING ELONGATED STRIPS ON AN AXLE MOUNTED CORE

[76] Inventor: Mirek Planeta, 5118 Everest Drive, Mississauga, Ontario, Canada, L4W 2R4

[21] Appl. No.: 699,109

[22] Filed: May 13, 1991

[30] Foreign Application Priority Data

May 14, 1990 [CA] Canada ..... 2016764

[51] Int. Cl.[5] ..... B65H 18/16; B65H 19/30

[52] U.S. Cl. ..... 242/65; 242/67.1 R

[58] Field of Search ..... 242/67.1 R, 65, 66, 242/79

[56] References Cited

U.S. PATENT DOCUMENTS 3,258,217 6/1966 MacArthur et al. ..... 242/65
4,390,138 6/1983 Rohde et al. ..... 242/65 X
5,042,272 8/1991 Furr ..... 242/79 X

*Primary Examiner*—Stanley N. Gilreath
*Attorney, Agent, or Firm*—Rogers & Scott

[57] ABSTRACT

A winding machine for winding a continuous strip of then sheet material, such as paper, metal or plastics, on to a succession of axle mounted cores has the axle engaged in a pair of arms that move the axle with a full roll to an unloading position at which one end is engaged by a retainer that holds the axle horizontal when support is removed from the other end. In one embodiment the axle is swung outwards until the other end is sufficiently clear of the support frame for the core and roll to be slid off the axle to a floor mounted receptor, such as a wheeled dolly. In another embodiment a part of the side frame plate of sufficient size is hinged to the rest of the plate and is moved out of the way to permit this sliding removal of the core and roll and mounting of a new core for the next roll.

4 Claims, 5 Drawing Sheets

MACHINE FOR WINDING ELONGATED STRIPS ON AN AXLE MOUNTED CORE

FIELD OF THE INVENTION

The invention provides an improved machine for winding an elongated strip on to a succession of axle-mounted cores to form a corresponding succession of core-mounted rolls thereof.

REVIEW OF THE PRIOR ART

There are a number of industries in which a continuously formed elongated thin strip of flexible material must be wound for storage and transport on to a succession of cores to form a corresponding succession of rolls. Particular examples are paper, thin sheet aluminium and plastics materials. A standard construction for such a machine is to provide an axle on which an empty core is mounted, the axle being mounted on the machine with the periphery of the core pressed tightly against a driver roll while the strip passes between them, so that the rotation of the driver roll causes the core to be driven and to wind the strip thereon. When the roll is sufficiently full it is rolled away from the driver roll while a new successive core and axle combination is put in place to continue the winding.

The full roll must now be removed from the machine and this presents an unexpectedly difficult handling problem. Thus, the axle may vary in length in the range 75–300 cm (30–120 ins) more usually in the range 150–200 cm (60–80 ins). Typically an empty axle of about 150 cm (60 ins) length weighs about 50 kg (110 lbs), but the resulting roll of a plastics material such as polyethylene can weigh in the range 114 to 680 kg (250 to 1500 lbs). With the longer axles the final weight can be as high as 1364 kg (3,000 lbs) This heavy and awkward load must be lifted out of the machine by some form of crane in a manner that ensures it is not damaged, and does not cause damage to the surroundings. After such removal the axle must be removed from the core and placed in a new core; the combination then being returned to the machine to form the next roll.

DEFINITION OF THE INVENTION

It is an object of the invention to provide a new winding machine for winding a continuously-produced strip on to a succession of axle mounted cores.

It is a specific object to provide such a machine with which the core mounted rolls can be removed therefrom without requiring the use of a lifting crane.

In accordance with the invention from one aspect there is provided a machine for winding an elongated strip on a core mounted on an axle to form a roll thereof, the machine comprising:

a support frame;

means mounting the axle on the support frame for rotation about a horizontal axis for the strip to be wound on the core, and for movement between a winding position for the winding of the roll and an unloading position for removal of a core and roll wound thereon endwise from the axle;

a support member providing axle end engaging means at the unloading position and mounted on the support frame to rotate about a vertical axis, the said engaging means engaging one end of the axle so as to hold the axle in a generally horizontal attitude while it is swung about the vertical axis until the other end of the axle is sufficiently clear of the support frame to permit the core and roll to be removed endwise off the axle.

According to the invention from another aspect there is provided a machine for winding an elongated strip on a core mounted on an axle to form a roll thereof, the machine comprising:

a support frame including two transversely-spaced parallel side members;

means mounting the axle on the support frame for rotation about a horizontal axis for the strip to be wound on the core and for movement between a winding position for winding of the roll and an unloading position for removal of a core and roll wound thereon from the axle;

axle end engaging means at the unloading position mounted on one of the side frames and engaging one end of the axle to hold it in a generally horizontal attitude when support is removed from the other end of the axle;

a movable portion of the other side frame that in a supporting position engages and supports the respective axle end while the axle and roll are at the unloading position and is movable relative to the remainder of the frame to a removal position to permit the core and roll to be moved enwise off the axle.

Preferably, the axle end engaging means comprises two axially spaced inboard and outboard stop members mounted on the support member and against which the axle rests;

a retainer member adjacent the outboard stop member movable to a retaining position in which it extends over the top of the axle to prevent upward movement of the outboard end of the axle and thereby hold the axle in the generally parallel attitude; and motor means connected between the support member and the support frame for selectively moving the support member about the vertical axis.

DESCRIPTION OF THE DRAWINGS

A winding machine that is a particular preferred embodiment of the invention will now be described, by way of example, with reference to the accompanying drawings, wherein.

DESCRIPTION OF THE PREFERRED EMBODIMENT

Figure 1:
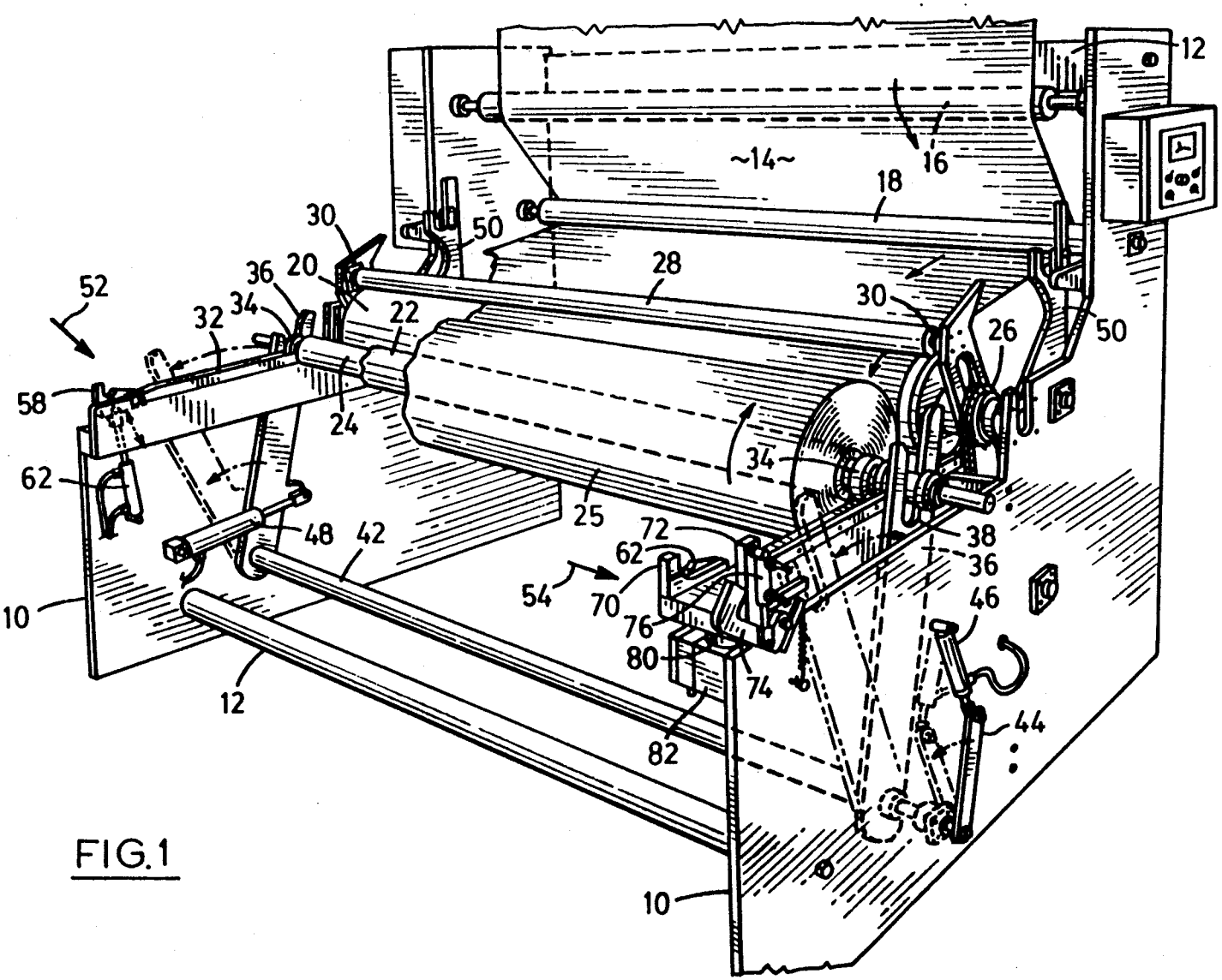
FIG. 1 is a perspective view toward a corner of the winding machine showing a partially filled roll in position and being wound with film.

The winding machine comprises two thick parallel metal side plates 10 which are connected rigidly together by transverse tie members, such as the top and bottom members 12 (FIG. 1), the others being omitted for clarity of illustration. A web 14 of the material to be rolled, usually a flattened tube of plastics material produced by die extrusion and subsequent expansion, is trained over rollers 16 and 18 to pass over a driven roll 20 onto a roll core 22 slidably mounted on axle 24, on which core it forms a roll 25. The roll 20 is driven from a motor (not shown) by a chain drive 26 and the web is held in firm engagement with its circumference by a pressure roller 28 mounted in rearings 30. The axle 24 is mounted in the winding machine so as to rest adjacent each end on a respective one of a pair of transversely-spaced longitudinal upwardly-opening channel tracks 32, each of which tracks is mounted on a horizontal edge of a respective side plate 10. The axle 24 is provided adjacent each end with a larger-diameter disc-like portion 34 that engages in the respective channel track 32 to prevent end-wise or longitudinal movement of the axle; the axle can however move freely backwards along the channel tracks as the roll increases in diameter.

The roll 25 is held firmly against the driven roll 20 by two upwardly-extending elongated arms 36 provided at their upper ends with respective open-ended slots 38 so that they can embrace respective journal portions 40 of the axle adjacent its ends. Each arm 36 is pivoted at its lower end to the respective side plate 10 by an axle 42 carrying at one end an arm 44 that connects the axle to a respective pneumatic spring 46, the spring providing a constant force urging the periphery of the roll 25 against that of the driver roll 20, so that the roll 25 is thereby driven to gather the strip.

Eventually, the roll 25 is a large as is required and must be removed, this being determined by any of the standard methods such as measurement of the roll diameter, or of the length of web that has been rolled on the core, or of the length of time for which web has been wound on the core. At this time the pressure in the spring 46 is released and a pneumatic motor 48 connected to one of the arms 36 is operated to swing the arms 36 anti-clockwise as seen in FIG. 1 toward the rear of the machine, moving the roll with them along the tracks 32 from the winding position to an unloading position at the ends of the tracks. At the end of their movement the axle 24 emerges from the slots 38, so that the arms can immediately be returned back to the loading position at the front of the machine to receive a new axle and core combination (not shown) that has previously been placed in a pair of forked pivoted arms 50, these arms now being lowered by a motor (not shown) to deliver the new axle into the track slots 38 to begin the winding of a new roll.

The full axle and roll is delivered by the arms 36 into respective end receiving stations 52 (FIG. 4) and 54 (FIGS. 2 and 3) at the unloading position, the station 52 being fixed, while the station 54 is pivotable about a vertical axis 56, as will be explained below. Thus, at the fixed station 52 the arms 36 deliver the axle so that the journal 40 at the respective end engages a vertically-movable L-shaped end stop 58, this stop being pivoted to the respective side frame 10 at 60 and being movable by a pneumatic motor 62 between an engaged position shown in broken lines in FIG. 4 and a disengaged position shown therein in solid lines. At the same time the other axle end at the movable station 54 passes over and depresses a latch 62 that is pivoted at 64 to an axle-end support member 66 and is urged upward by a spring 68. The axle end engages two axially spaced upwardly-extending fixed inboard and outboard end stops 70 and 72 respectively on the support member 66, whereupon the latch 62 rises behind it and holds it securely against the two stops. A strong U-shaped axle end retainer member 74 is pivoted at 76 at the end of one of its arms to the support 66 and is movable outboard of and alongside the outboard stop 72 by a motor 78 between a disengaged position shown in FIGS. 1 and 2 and an engaged position shown in FIGS. 3 and 5. In the engaged position the other arm of the U extends over the top of the axle outboard of the stop 72 and will prevent the outboard axle end from moving upward under the cantilevered weight of the remainder of the axle and the full roll 25. It will be noted that the tracks 32 terminate short of the unloading position.

Figure 2:
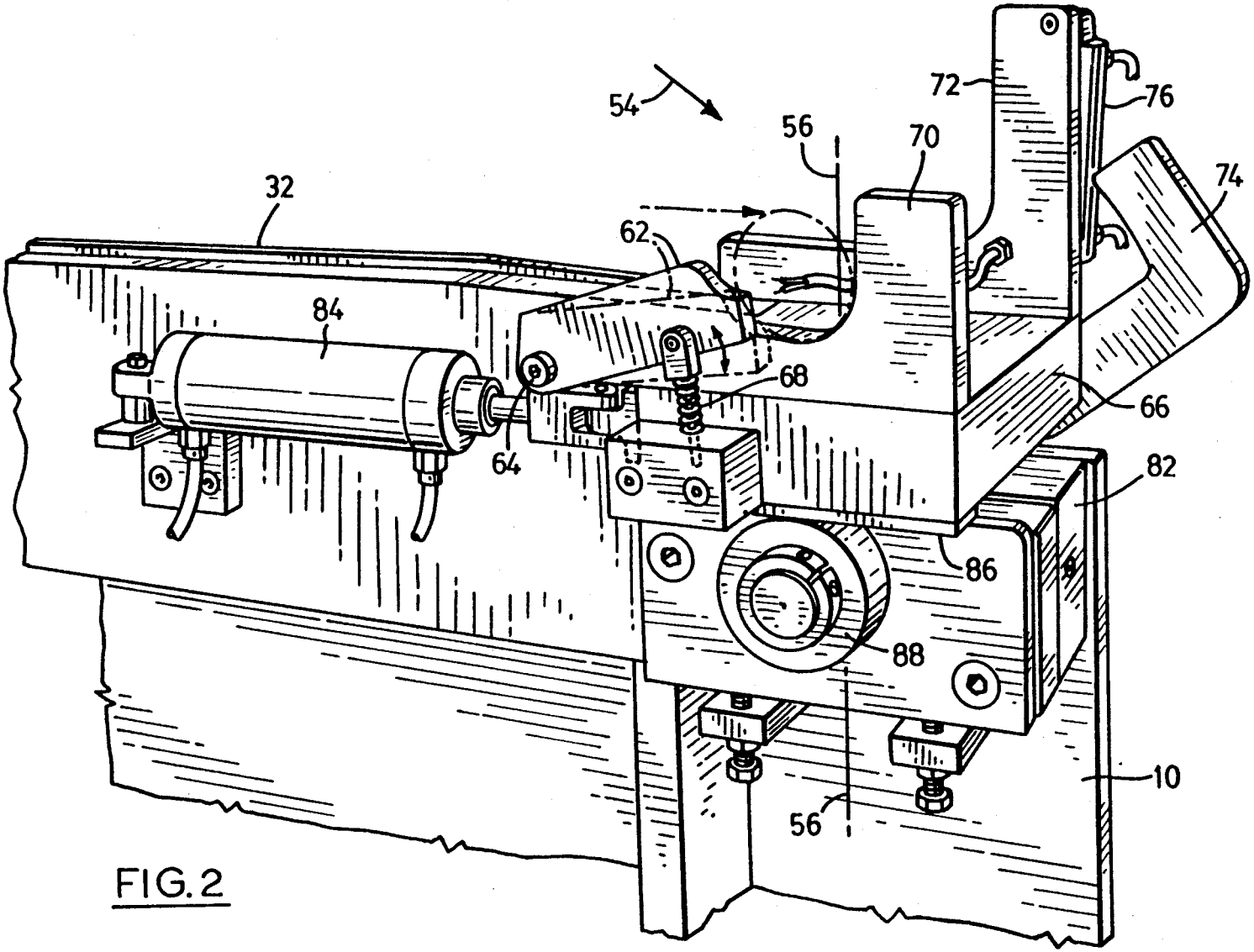
FIG. 2 is a perspective view of the empty pivoting roll-axle-receiving member of the machine, shown drawn to a larger scale.
Figure 3:
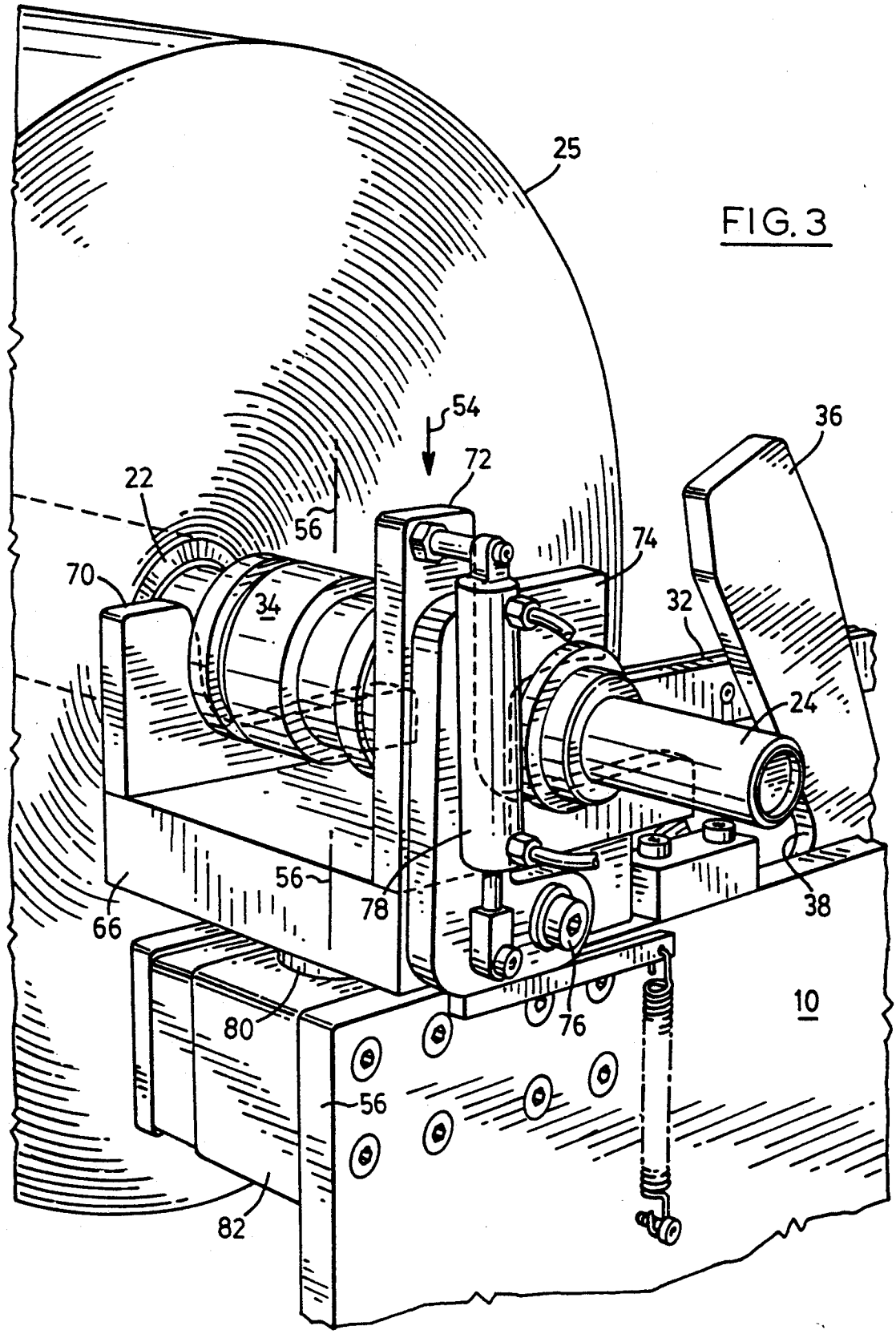
FIG. 3 is a perspective view in the same direction as FIG. 1, drawn to a larger scale, of the pivoting roll-axle-receiving member with one end of the axle of a fully wound roll engaged therein ready for pivoting motion.
Figure 4:
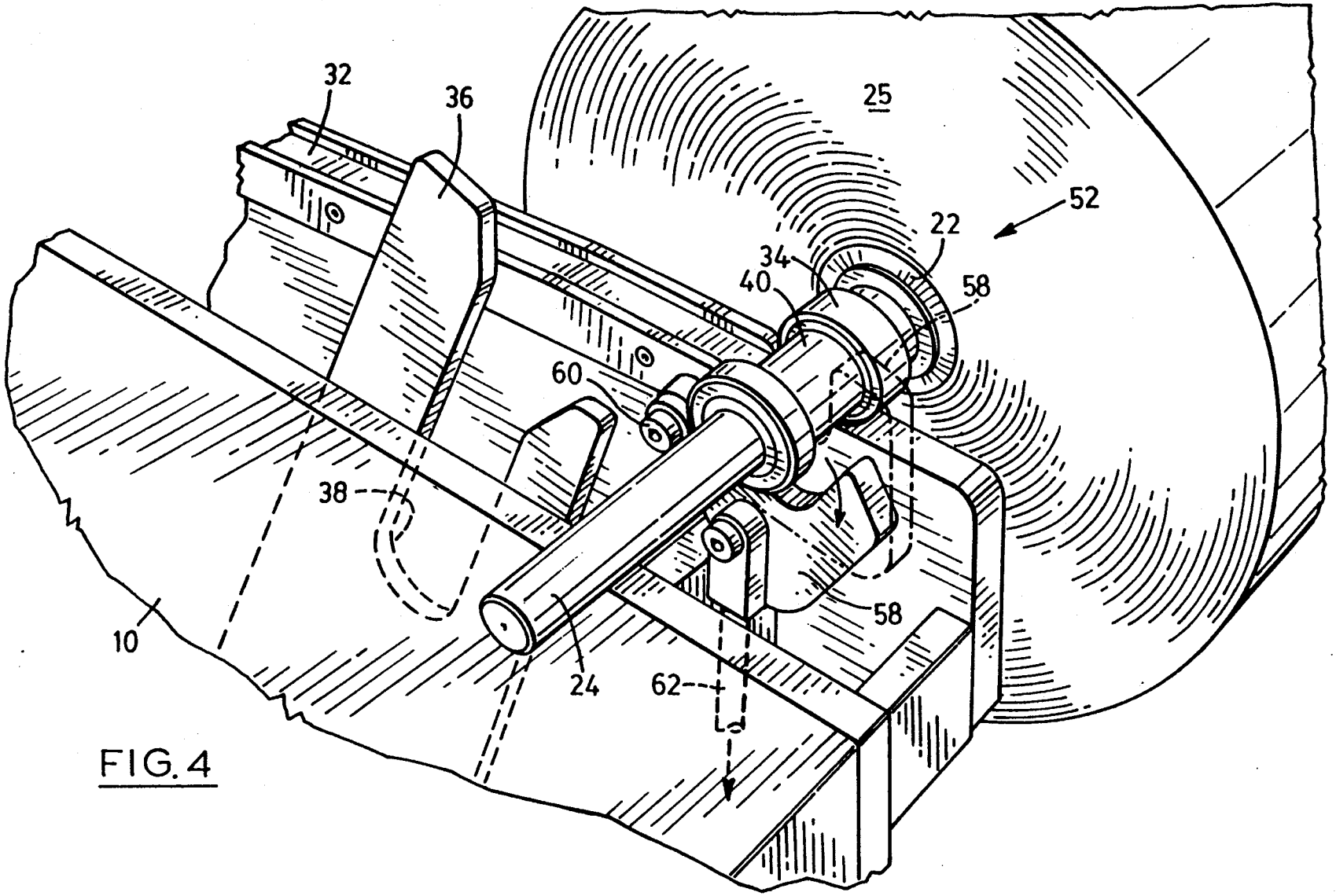
FIG. 4 is a perspective view of the non-pivoting axle-receiving structure for the other end of the axle.
Figure 5:
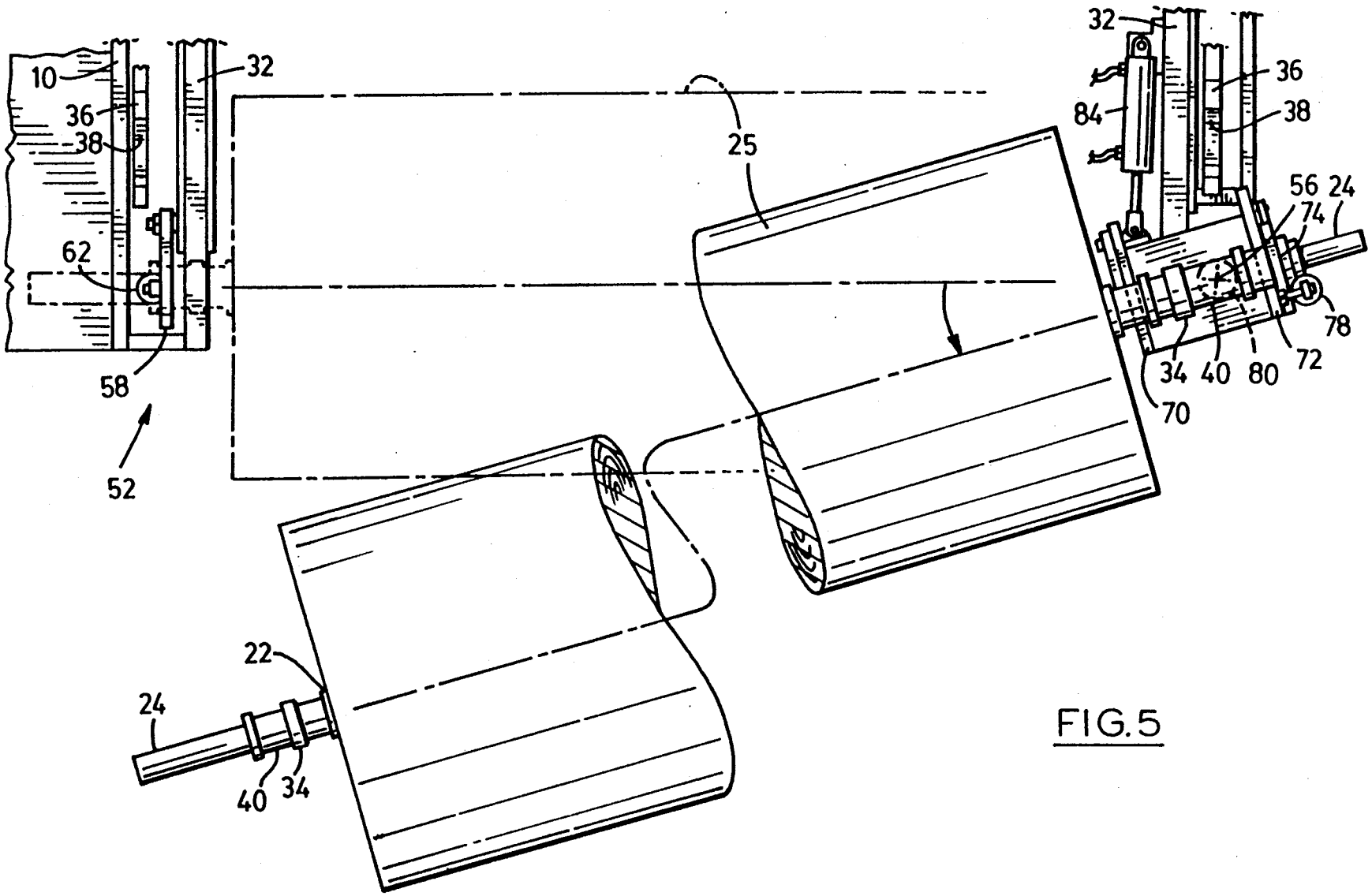
FIG. 5 is a plan view from above of the rear end of the machine, showing in broken lines a full roll that has been moved to the rear end, and in full lines the full roll pivoted to an unloading position.

The support 66 is pivotally mounted by a vertical shaft 80 on a mounting block 82 fastened to the side plate 10, so that the support is rotatable about the vertical axis 56 and is movable by a motor 84 connected between the support 66 and the side plate 10 back and forth between the parallel or swung-in position shown in FIGS. 2 and 3 and the swung-out position shown in FIG. 5. At the same time the latch 58 at the other end of the axle is lowered by its motor 62, so that this end can move to the swung-out position illustrated by FIG. 5, in which the core 22 and roll 25 can be slid off the axle 24 on to a suitable material handling receptor, such as a wheeled dolly. During this swinging movement, as soon as the axle end at the fixed station 52 has disengaged from the adjacent side plate, the full weight of the cantilevered axle, core and roll are applied to the edge of the support member 66 carrying the inboard stop member 70, and to resist this a replacable lower edge wear member 86 (FIG. 2) rests on a roller 88 rotatably mounted on the mounting block 82. The heavy roll and core can now easily be removed by sliding it along the axle into a simple wheeled dolly placed alongside, and a new core can easily be slid over the axle, the resulting new axle and core combination now being moved by the motor 84 back to the parallel swung in position. While the new roll is forming the new combination can easily be moved to the arms 50 to be ready for use in the production of the next roll.

I claim:

1. A machine for winding an elongated strip on a core mounted on an axle to form a roll thereon, the machine comprising:

a support frame, an axle to receive a core on which elongated strip is to be rolled, the support frame including two transversely spaced parallel side members having tracks supporting opposite end portions of the axle and along which the axle is movable from a winding position to an unloaded position, a driven roller at the winding position to engage elongated strip wound on a core on said axle to rotate said core and wind further strip thereon, means for driving said driven roller, means for moving said axle with strip wound on said core along said tracks from the winding position to the unloading position;

a support member having axle end engaging means mounted on one of the side members at the unloading position for rotation about a vertical axis, said axle end engaging means being engagable with one end of the axle to hold the axle in a generally horizontal attitude, and means to rotate the support member about the vertical axis until the other end of the axle is sufficiently clear of the support frame to permit the core and roll to be removed endwise off the axle.

2. A machine as claimed in claim 1, wherein the axle end engaging means comprises two axially spaced inboard and outboard stop members mounted on said one side member and against which the axle rests when said axle is at the unloading position;

a retainer member adjacent the outboard stop member movable to a retaining position in which said retainer member extends over the top of the axle to prevent upward movement of the outboard end of the axle and thereby hold the axle in the generally horizontal attitude.

3. A machine as claimed in claim 1, and including movable stop means mounted on the other side member for engagement with the axle adjacent the end further from the axle end engaging means, and motor means connected between the stop means and the support frame for selectively moving the stop means to permit the swinging of the axle about the vertical axis.

4. A machine as claimed in claim 2, and including movable stop means mounted on the other side member for engagement with the axle adjacent the end further from the axle end engaging means to stop movement of the respective axle end while the retainer member is being engaged with the other end, and motor means connected between the stop means and the support frame for selectively moving the stop means to permit the swinging of the axle about the vertical axis.

* * * * *